US006130194A

United States Patent [19]

Pancheri et al.

[11] Patent Number: 6,130,194

[45] **Date of Patent: *Oct. 10, 2000**

[54] CRYSTALLINE CALCIUM CARBONATE BUILDER ENROBED WITH A HYDROTROPE FOR USE IN DETERGENT COMPOSITIONS

[75] Inventors: Eugene Joseph Pancheri, Montgomery; Ronald Allen Swift, West Chester, both of Ohio

[73] Assignee: The Procter & Gamble Company, Cincinnati, Ohio

[ * ] Notice: This patent is subject to a terminal disclaimer.

[21] Appl. No.: 09/033,477

[22] Filed: Mar. 2, 1998

Related U.S. Application Data

[60] Provisional application No. 60/040,674, Mar. 11, 1997.

[51] Int. Cl.[7] ..... C11D 3/10; C11D 17/00

[52] U.S. Cl. ..... 510/349; 510/276; 510/441; 510/509; 134/42; 8/137

[58] Field of Search ..... 510/349, 441, 510/442, 276, 509; 134/42; 8/137

[56] References Cited

U.S. PATENT DOCUMENTS

| | | | |
|---|---|---|---|
| 3,932,316 | 1/1976 | Sagel et al. | 252/532 |
| 3,954,649 | 5/1976 | Lamberti | 252/174 |
| 3,957,695 | 5/1976 | Davies et al. | 252/532 |
| 3,979,314 | 9/1976 | Child | 252/140 |
| 3,981,686 | 9/1976 | Lobunez et al. | 23/302 |
| 3,992,314 | 11/1976 | Cherney | 252/160 |
| 3,997,692 | 12/1976 | Lamberti | 427/215 |
| 4,013,578 | 3/1977 | Child et al. | 252/140 |
| 4,022,702 | 5/1977 | Curtis | 252/89 R |
| 4,035,257 | 7/1977 | Cherney | 252/160 |
| 4,040,988 | 8/1977 | Benson et al. | 252/532 |
| 4,049,586 | 9/1977 | Collier | 252/532 |
| 4,051,054 | 9/1977 | Davies et al. | 252/89 R |
| 4,057,673 | 11/1977 | Falivene | 428/411 |
| 4,076,653 | 2/1978 | Davies et al. | 252/532 |
| 4,162,994 | 7/1979 | Kowalchuk | 052/532 |
| 4,171,291 | 10/1979 | Malhotra et al. | 252/554 |
| 4,196,093 | 4/1980 | Clarke et al. | 252/99 |
| 4,289,640 | 9/1981 | Falivene | 252/95 |
| 4,348,293 | 9/1982 | Clarke et al. | 252/90 |
| 4,352,678 | 10/1982 | Jones et al. | 51/307 |
| 4,407,722 | 10/1983 | Davies et al. | 252/91 |
| 4,473,485 | 9/1984 | Greene | 252/174.12 |
| 4,711,740 | 12/1987 | Carter et al. | 252/174.24 |
| 4,828,620 | 5/1989 | Mallow et al. | 106/100 |
| 4,900,466 | 2/1990 | Atkinson et al. | 252/174.14 |
| 4,908,159 | 3/1990 | Davies et al. | 252/559 |
| 4,966,606 | 10/1990 | Garner-Gray et al. | 252/174.14 |
| 5,219,541 | 6/1993 | Zolotoochin | 423/198 |
| 5,443,751 | 8/1995 | Mazzola | 252/174.13 |

FOREIGN PATENT DOCUMENTS

| | | | |
|---|---|---|---|
| 0 518 576 A2 | 6/1992 | European Pat. Off. | C11D 3/10 |
| WO 93/22411 | 11/1993 | WIPO | C11D 3/10 |

OTHER PUBLICATIONS

Bjorklund, Robert B. & Arwin, Hans, "Adsorption of anionic and cationic polymers on porous and non–porous calcium carbonate surfaces", Jun. 8, 1993, pp. 197–203.

Nancollas, G. H. & Reddy, M. M., "The Crystallization of Calcium Carbonate, II. Calcite Growth Mechanism[1]", Apr. 2, 1091, pp. 824–830.

Park, Nam–Seok, Kim, Myong–Won, Langford, S. C., & Dickinson, J. T., "Tribological Enhancement of $CaCO_3$ Dissolution during Scanning Force Microscopy", Jan. 16, 1996, pp. 4599–4604.

Wierzbicki, A., Sikes, C. S. Madura, J. D. & Drake, B., "Atomic Force Microscopy and Molecular Modeling of Protein and Peptide Binding to Calcite", Aug. 19, 1993, pp. 133–141.

*Primary Examiner*—William Krynski
*Assistant Examiner*—Dawn L. Garrett
*Attorney, Agent, or Firm*—David M. Goodrich; Kim William Zerby; Jacobus C. Rasser

[57] ABSTRACT

A detergent composition containing an inexpensive detergent builder in the form of a selected crystalline calcium carbonate that has been coated with a hydrotrope is provided. The crystalline calcium carbonate can be calcite and the hydrotrope can be xylene sulfonate. The crystalline calcium carbonate of the present invention is extremely inexpensive because it performs well even when used at large median particle sizes (e.g. less than 10 $m^2/g$ surface areas).

18 Claims, 3 Drawing Sheets

CRYSTALLINE CALCIUM CARBONATE BUILDER ENROBED WITH A HYDROTROPE FOR USE IN DETERGENT COMPOSITIONS

CROSS REFERENCE TO RELATED APPLICATION

This application claims priority under Title 35, United States Code 119(e) from Provisional Application Ser. No. 60/040,674, filed Mar. 11, 1997.

FIELD OF THE INVENTION

The invention is directed to an inexpensive builder material for use in detergent compositions. More particularly, the invention provides a crystalline calcium carbonate material that is encapsulated with a hydrotrope. This very inexpensive builder material is especially suitable for use in detergent compositions used in fabric laundering, bleaching, automatic or hand dishwashing, hard surface cleaning and in any other application which requires the use of a builder material to remove water hardness.

BACKGROUND OF THE INVENTION

It is common practice for formulators of cleaning compositions to include, in addition to a cleaning active material, a builder to remove hardness cations (e.g. calcium cations and magnesium cations) from washing solution which would otherwise reduce the efficiency of the cleaning active material (e.g. surfactant) and render certain soils more difficult to remove. For example, laundry detergent compositions typically contain an anionic surfactant and a builder to reduce the effects of hardness cations in wash solutions. In this context, the builder sequesters or "ties up" the hardness cations so as to prevent them from hindering the cleaning action of the anionic surfactant in the detergent composition.

As is well known, water-soluble phosphate materials have been used extensively as detergency builders. However for a variety of reasons, including eutrophication of surface waters allegedly caused by phosphates, there has been a desire to use other builder materials in many geographic areas. Other known builders include water-soluble builder salts, such as sodium carbonate, which can form precipitates with the hardness cations found in washing solutions. Unfortunately, the use of such builders alone does not reduce the level of hardness cations at a sufficiently rapid rate. For practical purposes, the acceptable level is not reached within the limited time required for the desired application, e.g. within 10 to 12 minutes for fabric laundering operations in North America and Japan.

Moreover, some of these water-soluble builder salts, while attractive from the point of view of cost, have several disadvantages, among which are the tendency of the precipitates formed in aqueous washing solutions (e.g. insoluble calcium carbonate) to become deposited on fabrics or other articles to be cleaned. One alleged solution to this problem has been to include a water-insoluble material which would act as a "seed crystal" for the precipitate (i.e. calcium carbonate). Of the many materials suggested for such use, very small particle size calcite has been the most popular.

However, the inclusion of calcite in detergent compositions has been problematic because of the sensitivity of the hardness cation/salt anion (e.g. calcium/carbonate) reaction product to poisoning by materials (e.g. polyacrylate or certain anionic surfactants) which may be present in the washing solution. Without being limited by theory, the poisoning problem prevents the reaction product from forming in that crystallization onto the seed crystal is inhibited. Consequently, calcite typically has to be produced in a very small particle size in order to have a larger surface area which is harder to poison. This, however, renders the very small calcite particle dusty and difficult to handle. Moreover, the required particle sizes are so small (at least having 15 $m^2/g$ or more of surface area) that manufacturing of such calcite particles is extremely expensive. For example, production of such small calcite particles may require a controlled "growing" process which is extremely expensive. Another problem associated with the use of calcite as a "seed crystal" for the poisons and precipitates in washing solutions is the difficulty experienced in adequately dispersing the calcite in the washing solution so that it does not deposit on fabrics or articles which have been subjected to cleaning operations. Such deposits or residues are extremely undesirable for most any cleaning operation, especially in fabric laundering and tableware cleaning situations.

The prior art is replete with suggestions for dealing with the handling and dispersability problems associated with calcite. One previously proposed means for handling calcite is to incorporate it into a slurry, but this involves high storage and transportation costs. Another proposed option involves granulating calcite with binding and dispersing agents to ensure adequate dispersment in the wash solution. However, this option also has been difficult to implement effectively in modern day detergent compositions because the calcite granules have poor mechanical strength which continue to make them difficult to handle and process, especially when required to be very small in size. Additionally, effective binding and dispersing agents for the calcite have not been discovered to date. Specifically, most of the binding and dispersing agents proposed by the prior art are themselves poisons which reduce the "seed activity" of the calcite. Consequently, it would be desirable to have an improved inexpensive builder material which overcomes the aforementioned limitations and is easy to handle, readily dispersible in washing solutions and exhibits improved builder performance.

Accordingly, despite the aforementioned disclosures, there remains a need in the art for an inexpensive builder material for use in detergent compositions which exhibits superior performance and is less expensive to manufacture in that it does not require a very small particle size. There is also a need in the art for such a builder material which is easy to handle (i.e., is not "dusty"), easy to process and readily disperses in washing solutions.

BACKGROUND ART

The following references are directed to builders for various detergent compositions: Atkinson et al, U.S. Pat. No. 4,900,466 (Lever); Houghton, WO 93/22411 (Lever); Allan et al, EP 518 576 A2; (Lever); Zolotoochin, U.S. Pat. No. 5,219,541 (Tenneco Minerals Company); Gamer-Gray et al, U.S. Pat. No. 4,966,606 (Lever); Davies et al, U.S. Pat. No. 4,908,159 (Lever); Carter et al, U.S. Pat. No. 4,711,740 (Lever); Greene, U.S. Pat. No. 4,473,485 (Lever); Davies et al, U.S. Pat. No. 4,407,722 (Lever); Jones et al, U.S. Pat. No. 4,352,678 (Lever); Clarke et al, U.S. Pat. No. 4,348,293 (Lever); Clarke et al, U.S. Pat. No. 4,196,093 (Lever); Benjamin et al, U.S. Pat. No. 4,171,291 (Procter & Gamble); Kowalchuk, U.S. Pat. No. 4,162,994 (Lever); Davies et al, U.S. Pat. No. 4,076,653 (Lever); Davies et al, U.S. Pat. No. 4,051,054 (Lever); Collier, U.S. Pat. No. 4,049,586 (Procter & Gamble); Benson et al, U.S. Pat. No. 4,040,988 (Procter & Gamble); Cherney, U.S. Pat. No. 4,035,257 (Procter & Gamble); Curtis, U.S. Pat. No. 4,022,702 (Lever); Child et al, U.S. Pat. No. 4,013,578 (Lever); Lamberti, U.S. Pat. No. 3,997,692 (Lever); Cherney, U.S. Pat. No. 3,992,314 (Procter & Gamble); Child, U.S. Pat. No. 3,979,314 (Lever); Davies et al, U.S. Pat. No. 3,957,695 (Lever); Lamberti, U.S. Pat. No. 3,954,649 (Lever); Sagel et al U.S. Pat. No. 3,932,316 (Procter & Gamble); Lobunez et al, U.S. Pat. No. 3,981,686 (Intermountain Research and Development Corp.); Mallow et al, U.S. Pat. No. 4,828,620 (Southwest Research Institute); Bjorklund et al, "Adsorption of Anionic and Cationic Polymers on Porous and Non-porous Calcium Carbonate Surfaces," *Applied Surface Science* 75 pp. 197–203 (1994); Wierzbicki et al, "Atomic Force Microscopy and Molecular Modeling of Protein and Peptide Binding to Calcite," *Calcified Tissue International* 54, pp. 133–141 (1994); Park et al, "Tribological Enhancement of $CaCO_3$ Dissolution during Scanning Force Microscopy," *Langmuir*, pp. 4599–4603, 12 (1996); and Nancollas et al, "The Crystallization of Calcium Carbonate," *Journal of Colloid and Interface Science*, Vol. 37, No. 4, pp. 824–829 (December 1971).

SUMMARY OF THE INVENTION

The aforementioned needs in the art are met by the present invention which provides a detergent builder in the form of a crystalline calcium carbonate that is enrobed with a hydrotrope. Specifically, the crystalline calcium carbonate (e.g. calcite) has a surface area less than about 10 $m^2/g$, and thus, is easy to handle and process. Optionally, the crystalline calcium carbonate can have a substantially rhombohedral crystal structure with {1,0,–1,1} crystallographic indices. The crystalline calcium carbonate of the present invention is extremely inexpensive because it can be readily formed from inexpensive naturally occurring calcite and it performs well even when used at large median particle sizes.

In accordance with one aspect of the invention, a detergent composition is provided. The detergent composition comprises: (a) from about 0.1% to about 80% by weight of a crystalline calcium carbonate, said crystalline calcium carbonate being substantially enrobed with a hydrotrope and having a surface area less than about 10 $m^2/g$; (b) at least about 1% by weight of a detersive surfactant; and (c) the balance adjunct detergent ingredients.

In a preferred aspect of the invention, a detergent composition having especially preferred features is provided. This detergent composition comprises: (a) from about 0.1% to about 80% by weight of crystalline calcium carbonate, the crystalline calcium carbonate being substantially enrobed with a hydrotrope and having a rhombohedral crystalline structure with {1,0,–1,1} crystallographic indices, wherein the crystalline calcium carbonate has a surface area of from about 0.01 $m^2/g$ to about 4 $m^2/g$; (b) at least about 1% by weight of a detersive surfactant; and (c) from about 2% to about 80% by weight of sodium carbonate. The sodium carbonate and the crystalline calcium carbonate are in a weight ratio of about 1:1 to about 5:1. This detergent composition is substantially free of phosphates.

The invention also provides a method for laundering soiled fabrics comprising the steps of contacting the soiled fabrics with an aqueous solution containing an effective amount of a detergent composition as described herein. Also, provided is a method for cleaning surfaces comprising the steps of contacting the surfaces with an aqueous solution containing an effective amount of a detergent composition as described herein.

Accordingly, it is an object of the invention to provide a detergent composition containing an inexpensive builder material which exhibits superior performance and is less expensive to manufacture in that it does not require a very small particle size. It is also an object of the invention to provide such a builder material which is easy to handle (i.e., is not "dusty"), easy to process and readily disperses in washing solutions. These and other objects, features and attendant advantages of the present invention will become apparent to those skilled in the art from a reading of the following detailed description of the preferred embodiment and the appended claims.

All percentages, ratios and proportions used herein are by weight (anhydrous basis) unless otherwise specified. All documents including patents and publications cited herein are incorporated herein by reference.

BRIEF DESCRIPTION OF THE DRAWINGS

(FIG. 8 is a partial perspective depicting only the top portion of the crystal).

DETAILED DESCRIPTION OF THE PREFERRED EMBODIMENT

The detergent composition of the invention can be used in a variety of applications including but not limited to fabric laundering, fabric or surface bleaching, automatic or hand dishwashing, hard surface cleaning and any other application which requires the use of a builder material to remove water hardness.

Figure 1:
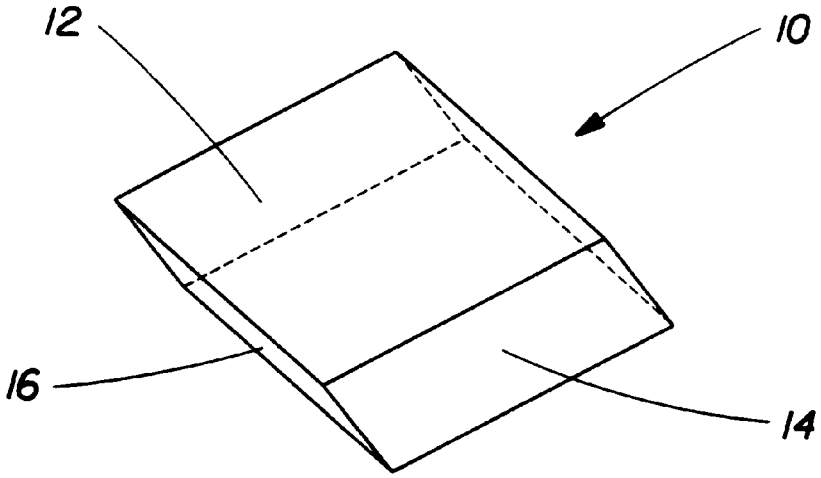
FIG. 1 illustrates a specifically modified crystalline calcium carbonate structure suitable for use in the invention.

As used herein, the phrase "effective amount" means that the level of the builder material in the composition is sufficient to sequester an adequate amount of hardness in the washing solution such that the detersive surfactant is not overly inhibited. As used herein, the word "crystalline" means a mixture or material having a regularly repeating internal arrangement (i.e., "lattice") of its atoms and external plane faces. As used herein, the phrase "substantially having a rhombohedral crystalline structure" means a crystal having the form of a parallelogram and no right angles (e.g., as depicted in FIG. 1). As used herein, "{1,0,–1,1} crystallographic indices" refers to a specific set of crystal planes on a hexagonal coordinate system which defines a selected crystalline structure (also referenced as the "Miller indices" for a hexagonal coordinate system). As used herein, the phrase "crystalline calcium carbonate" refers to the chemical entity, calcium carbonate, in crystalline form, of which the most common form is referenced as "calcite". Also see standard texts on all of these subjects, such as Blackburn et al, *Principles of Mineralogy,* 2nd Ed., pp. 21–51 (1994) and Klein et al, *Manual of Mineralogy*, p. 405 et seq (1977). As used herein, the terms "encapsulated" and "enrobed" means that the hydrotrope covers at least a majority portion of the outer surface of the crystalline calcium carbonate regardless of its overall shape. As used herein, the phrase "median particle size" means the "mean" particle size in that about 50% of the particles are larger and about 50% are smaller than this particle size as measured by standard sieve analysis.

Crystalline Calcium Carbonate Builder

The crystalline calcium carbonate used in the detergent composition of the present invention can take a variety of forms, including but not limited to, calcite, aragonite, vaterite and mixtures thereof. The variety of forms of calcite are depicted in FIGS. 1–8. The most preferred crystalline calcium carbonate has a substantially rhombohedral crystalline structure 10 as depicted in FIG. 1. This crystalline calcium carbonate is defined by {1,0,–1,1} crystallographic or Miller indices. It has been surprisingly found that by judiciously selecting a crystalline calcium carbonate of such a crystalline configuration, superior builder performance (i.e., removal of water hardness) can be achieved when used in typical detergent compositions for laundering soiled clothes. The median particle size of this crystalline calcium carbonate as detailed hereinafter is not required to be in the very small range (e.g., less than about 2 microns with a surface areas at least about 15 $m^2/g$).

While not intending to be bound by theory, it is believed that the outer surfaces, e.g., 12, 14 and 16 depicted in FIG. 1, have a significantly high population of oxygen atoms which lends the entire crystalline structure to have more of an affinity to calcium cations which is the predominant source of water hardness. Those skilled in the art will appreciate that this is a crystal having {1,0,–1,1} crystallographic indices and its crystal faces are defined thereby. By contrast, FIGS. 2–8 define crystal structures of crystalline calcium carbonate or calcite which do not substantially have a rhombohedral crystalline structure with {1,0,–1,1} crystallographic indices, although they are suitable for use in the present invention as well. Moreover, all of the crystal faces or cleavage planes of the calcite crystal structures depicted in FIGS. 2–8 can have a much higher population of calcium atoms, thereby creating a strong positive charge on the outer surfaces of these crystals. This, as those skilled in the art will appreciate, does cause these crystalline structures to be less effective at sequestering water hardness cations.

Figure 2:
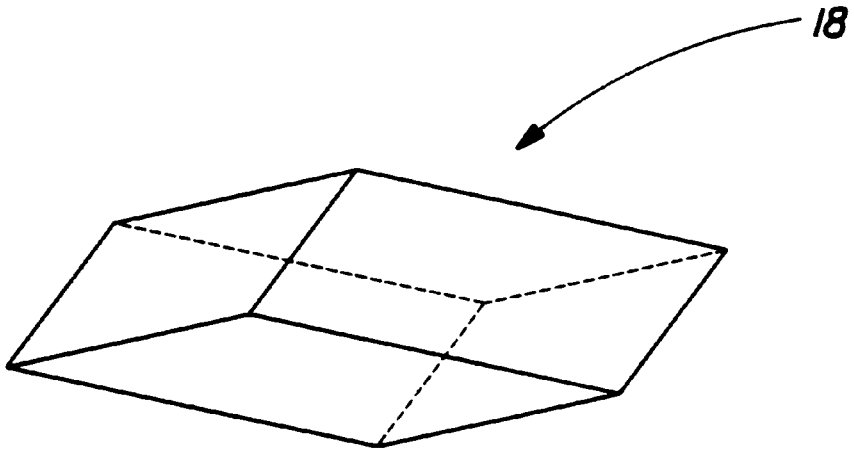
FIGS. 2–8 illustrates naturally occurring crystalline calcium carbonate structures that are commonly found in nature
Figure 3:
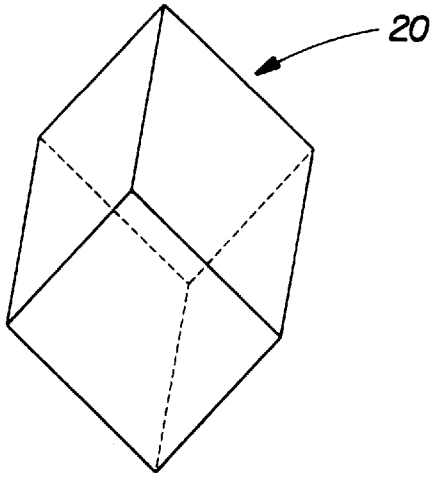
Figure 4:
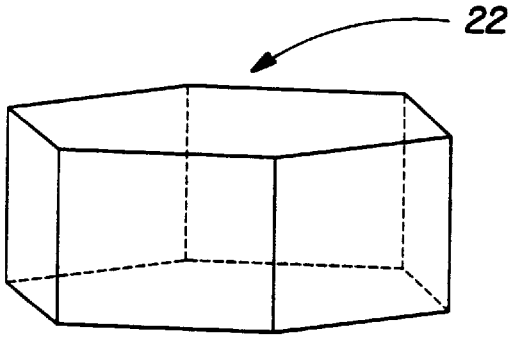
Figure 5:
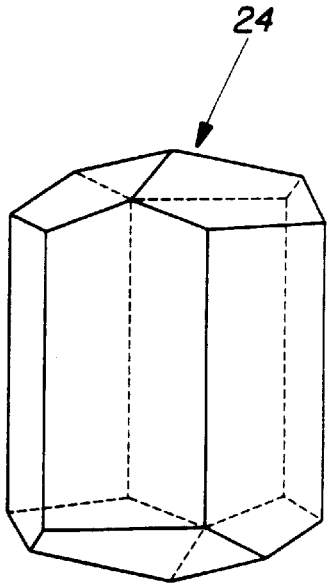
Figure 6:
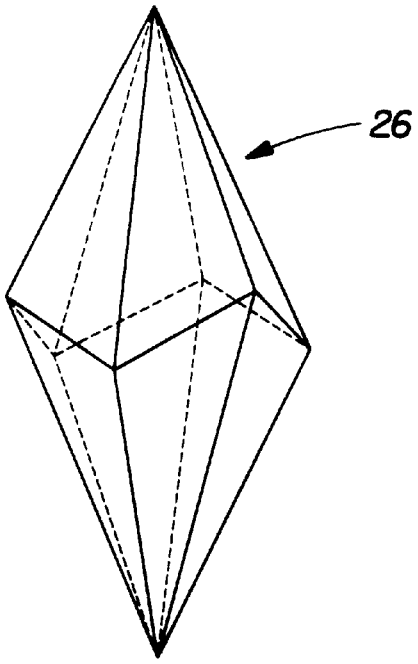
Figure 7:
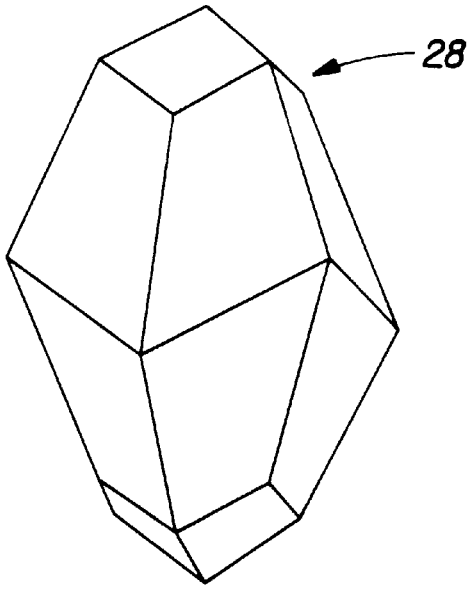
Figure 8:
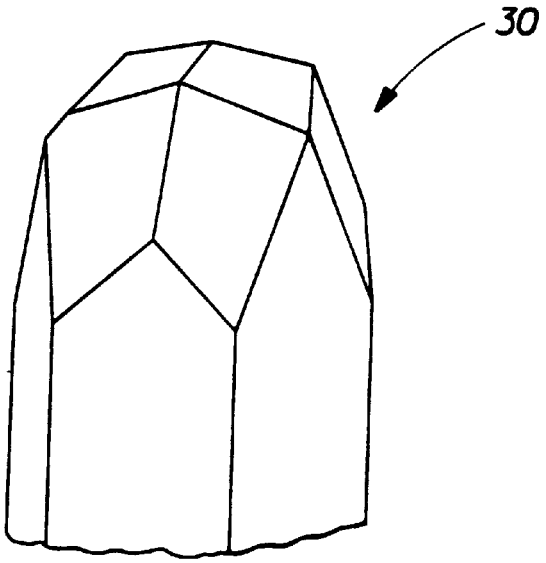

Specifically, FIG. 2 depicts a crystalline calcium carbonate having a rhombohedral structure 18, but with {0,1,–1,2} crystallographic indices. FIG. 3 illustrates crystalline calcium carbonate or calcite in a cubic crystal structure 20 having {0,2,–2,1} crystallographic indices. FIG. 4 depicts a hexagonal crystal structure 22 with {1,0,–1,0} and {0,0,0,1} crystallographic indices, while FIG. 5 shows a prismatic structure 24 with {1,0,–1,0} and {0,1,–1,2} crystallographic indices. FIG. 6 depicts a crystalline calcium carbonate structure 26 having {2,1,–3,1} crystallographic indices, and FIG. 7 illustrates a scalenohedral calcite crystal structure 28 with {2,1,–3,1} and small faces with the preferred {1,0,–1,1} crystallographic indices. Lastly, FIG. 8 illustrates atop partial perspective view of yet another calcium carbonate crystalline structure 30 which has {0,1,–1,2}, {2,1,–3,1} and {1,0,–1,0} crystallographic indices.

FIGS. 3, 4, 5 and 7 depict the most common calcite crystals found in nature. Furthermore, it is believed that the calcite crystal structures of FIGS. 2–8 do not perform as well as the FIG. 1 structure because the FIGS. 2–8 structures have a high population of calcium atoms at their respective crystal planes (i.e., outer surfaces), thereby resulting in poor performance relative to water hardness cation sequestration. To the contrary, as mentioned previously, the calcite crystal depicted in FIG. 1 has a high population of oxygen atoms and low population of calcium atoms on its respective cleavage planes (i.e., {1,0,–1,1} crystallographic indices) rendering it a particularly effective seed crystal for water hardness cation (e.g., calcium cations) sequestration. This results in a superior performing detergent composition as the deleterious effects of water hardness on surfactant performance is eliminated or severely inhibited.

The "crystalline" nature of the builder material can be detected by X-ray Diffraction techniques known by those skilled in the art. X-ray diffraction patterns are commonly collected using Cu $K_{alpha}$ radiation on an automated powder diffractometer with a nickel filter and a scintillation counter to quantify the diffracted X-ray intensity. The X-ray diffraction diagrams are typically recorded as a pattern of lattice spacings and relative X-ray intensities. In the Powder Diffraction File database by the Joint Committee on Powder Diffraction Standards—International Centre for Diffraction Data, X-ray diffraction diagrams of corresponding preferred builder materials include, but are not limited to, the following numbers: 5-0586 and 17-0763.

The actual amount of crystalline calcium carbonate builder used in the detergent composition of the invention will vary widely depending upon the particular application. However, typical amounts are from about 0.1% to about 80%, more typically from about 4% to about 60%, and most typically from about 6% to about 40%, by weight of the detergent composition. The median particle size of the builder is preferably from about 0.2 microns to about 20 microns, more preferably from about 0.3 microns to about 15 microns, even more preferably from about 0.4 microns to about 10 microns, and most preferably from about 0.5 microns to about 10 microns. While the crystalline calcium carbonate builder used in the detergent composition herein performs at any median particle size, it has been found that optimum overall performance can be achieved within the aforementioned median particle size ranges.

In addition to the median particle size or in the alternative to it, the crystalline calcium carbonate builder preferably has selected surface area for optimal performance. More specifically, the crystalline calcium carbonate has a surface area of less than about 10 $m^2/g$. Other more preferable surface area ranges for use herein include from about 0.01 $m^2/g$ to about 12 $m^2/g$, even more preferably from about 0.1 $m^2/g$ to about 10 $m^2/g$, yet more preferably from about 0.2 $m^2/g$ to about 5 $m^2/g$, and most preferably from about 0.2 $m^2/g$ to about 4 $m^2/g$. Other suitable surface area ranges also include from about 0.1 $m^2/g$ to about 4 $m^2/g$ and from about 0.01 $m^2/g$ to about 4 $m^2/g$. The surface areas can be measured by standard techniques including by nitrogen adsorption using the standard Bruauer, Emmet & Teller (BET) method. A suitable machine for this method is a Carlo Erba Sorpty 1750 instrument operated according to the manufacturer's instructions.

The crystalline calcium carbonate builder used in the detergent composition herein also unexpectedly has improved builder performance in that it has a high calcium ion exchange capacity. In that regard, the builder material has a calcium ion exchange capacity, on an anhydrous basis, of at least about 100 mg equivalent of calcium carbonate hardness/gram, more preferably at least about 200 mg, and even more preferably at least about 300 mg, and most preferably from at least about 400 mg, equivalent of calcium carbonate hardness per gram of builder. Additionally, the builder unexpectedly has an improved calcium ion exchange rate. On an anhydrous basis, the builder material has a calcium carbonate hardness exchange rate of at least about 5 ppm, more preferably from about 10 ppm to about 150 ppm, and most preferably from about 20 ppm to about 100 ppm, $CaCO_3$/minute per 200 ppm of the builder material. A wide variety of test methods can be used to measure the aforementioned properties including the procedure exemplified hereinafter and the procedure disclosed in Corkill et al, U.S. Pat. No. 4,605,509 (issued Aug. 12, 1986), the disclosure of which is incorporated herein by reference.

In a preferred embodiment of the invention, the detergent composition is substantially free of phosphates and phosphonates. As used herein, "substantially free" means has less than 0.05% by weight of a given material. Alternatively, or in addition to the foregoing phosphate limitation, the detergent composition is substantially free of soluble silicates, especially if magnesium cations are part of the water hardness composition in the particular use and the detergent composition of the invention does not include an auxiliary builder to sequester such cations. In this regard, superior performance of the detergent composition containing the aforedescribed builder can be achieved if the detergent composition is substantially free of polycarboxylates, polycarboxylic oligomer/polymers and the like. It has also been found that optimal performance can be achieved using such materials in the detergent composition so long as the polycarboxylate is pre-blended with the surfactant before exposure to the crystalline calcium carbonate, either during manufacture of the detergent composition or during use.

In another preferred aspect of the invention, the detergent composition is substantially free of potassium salts, or if they are present, are included at very low levels. Specifically, the potassium salts are included at levels of about 0.01% to about 5%, preferably at about 0.01% to about 2% by weight of the detergent composition.

Preferably, if sodium sulfate and sodium carbonate are included in the detergent composition, they are preferably in a weight ratio of about 1:50 to about 2:1, more preferably from about 1:40 to about 1:1, most preferably from about 1:20 to about 1:1 of sodium sulfate to sodium carbonate. While not intending to be bound by theory, it is believed that excessive amounts of sulfate relative to carbonate may interfere with the builder performance of the crystalline calcium carbonate. Preferably, if sodium carbonate is included in the detergent composition, it is included preferably in a weight ratio of about 1:1 to about 20:1, more preferably from about 1:1 to about 10:1, most preferably from about 1:1 to about 5:1 of sodium carbonate to crystalline calcium carbonate builder. Additionally or in the alternative, sodium carbonate is present in the detergent composition in an amount of from about 2% to about 80%, more preferably from about 5% to about 70%, and most preferably from about 10% to about 50% by weight of the detergent composition.

The crystalline calcium carbonate in accordance with the invention (FIG. 1) can be made in a variety of ways so long as the resulting crystal substantially has a rhombohedral crystalline structure with {1,0,–1,1} crystallographic indices. Preferably, the starting ingredient is crystalline calcium carbonate which does not have the aforementioned crystal structure. There are a multitude of possible starting crystalline calcium carbonates suitable for use in the process. By way of example, naturally occurring calcite such as the one depicted in FIG. 5 can be mined or commercially purchased and subjected to the process described hereinafter.

As used herein, the word "milling" means crushing, grinding or otherwise affecting the physical structure of the crystalline calcium carbonate. In a preferred embodiment, the process first involves feeding starting crystalline calcium carbonate into an apparatus having an internal chamber and air nozzles directed into the chamber. One convenient apparatus in which such milling can occur is an Alpine Fluid Bed Jet Mill (Model 100 AFG Fluid Bed Jet Mill commercially available from Hosokawa Micron—Alpine, Germany). Other suitable apparatus are commercially available from Hosokawa Micron—Alpine, Germany are sold under the trade names Table Top Roller Mill, Aeroplex, Ecoplex and Turboplex. In this step of the process, the starting crystalline calcium carbonate is milled in such apparatus by inputting and grinding with air at a pressure from about 1 bar to about 50 bar, more preferably from about 1.5 bar to about 10 bar, and most preferably from about 2.5 bar to about 5 bar. In this way, the starting crystalline calcium carbonate is converted to a rhombohedral crystalline structure with {1,0,–1,1} crystallographic indices, thereby forming the detergent builder.

This selected milling process step in which the starting ingredient (e.g., calcite) is milled involves crushing and/or grinding the starting crystalline calcium carbonate such that it is cleaved to form the aforementioned crystalline calcite structure (FIG. 1). While not intending to be bound by theory, it is believed that the {1,0,–1,1} crystallographic indices define "low stress" planes of larger naturally occurring calcite along which cleavage can occur if milled with selected process parameters.

Hydrotrope

The granular detergent composition of the present invention preferably includes a hydrotrope such a those commonly used in liquid detergents. It has been surprisingly found that by enrobing the crystalline calcium carbonate builder with a hydrotrope, the crystalline calcium carbonate performs well, even when included at relatively large median particle sizes. While not intending to be bound by theory, it is believed that the hydrotrope inhibits poisoning from surfactants such as linear alkylbenzene sulfonates ("LAS") even when the particle size of the crystalline calcium carbonate is rather large as detailed previously. The hydrotrope is preferably in the form of a liquid or paste which is mixed with the crystalline calcium carbonate such that it enrobes the outer surfaces of the individual calcium carbonate particles. Typically, the liquid or paste hydrotrope is mixed in any conventional mixer with the crystalline calcium carbonate to form the desired coated particles. It has been found that while any of the crystalline calcium carbonates described herein are suitable, those crystalline calcium carbonates not having a rhombohedral crystalline structure with {1,0,–1,1} crystallographic indices benefit more from the hydrotrope coating.

Those skilled in the art will appreciate the wide variety of hydrotropes useful for the instant detergent composition. Preferably, however, the hydrotrope is selected from the group consisting of sulfyl succinates, xylene sulfonates, cumene sulfonates, toluene sulfonates and mixtures thereof. Most preferred are the sodium salts of the aforementioned preferred hydrotropes such as sodium sulfyl succinate. Other suitable hydrotropes include naphthalene sulfonates, benzoates, salicylates, gallates, hydroxy naphthoates, picolinates. These and other suitable hydrotropes for use herein are described in known texts such as Mitijevic, "Surface and Colloid Science" Plenum Press, vol 15 (1993), the disclosure of which is incorporated herein by reference.

The preferred detergent composition of the invention comprises from about 1% to about 50%, preferably from about 15% to about 40%, by weight of a hydrotrope. The weight ratio of the hydrotrope to crystalline calcium carbonate described herein is from about 4:1 to about 1:99, preferably from about 2:1 to about 1:90, more preferably from about 1:1 to about 1:80, and most preferably from about 1:2 to about 1:70.

Detergent Compositions

The detergent compositions of the invention can contain all manner of organic, water-soluble detergent compounds, inasmuch as the builder material are compatible with all such materials. In addition to a detersive surfactant, at least one suitable adjunct detergent ingredient is preferably included in the detergent composition. The adjunct detergent ingredient is preferably selected from the group consisting of auxiliary builders, enzymes, bleaching agents, bleach activators, suds suppressers, soil release agents, brighteners, perfumes, hydrotropes, dyes, pigments, polymeric dispersing agents, pH controlling agents, chelants, processing aids, crystallization aids, and mixtures thereof. The following list of detergent ingredients and mixtures thereof which can be used in the compositions herein is representative of the detergent ingredients, but is not intended to be limiting.

Detersive Surfactant

Preferably, the detergent compositions herein comprise at least about 1%, preferably from about 1% to about 55%, and most preferably from about 10 to 40%, by weight, of a detersive surfactant selected from the group consisting of anionic surfactants, nonionic surfactants, cationic surfactants, zwitterionic surfactants and mixtures. Nonlimiting examples of surfactants useful herein include the conventional $C_{11}$–$C_{18}$ alkyl benzene sulfonates ("LAS") and primary, branched-chain and random $C_{10}$–$C_{20}$ alkyl sulfates ("AS"), the $C_{10}$–$C_{18}$ secondary (2,3) alkyl sulfates of the formula $CH_3(CH_2)_x(CHOSO_3^-M^+)$ $CH_3$ and $CH_3$ $(CH_2)_y$ $(CHOSO_3^-M^+)$ $CH_2CH_3$ where x and (y+1) are integers of at least about 7, preferably at least about 9, and M is a water-solubilizing cation, especially sodium, unsaturated sulfates such as oleyl sulfate, the $C_{10}$–$C_{18}$ alkyl alkoxy sulfates ("$AE_xS$"; especially EO 1–7 ethoxy sulfates), $C_{10}$–$C_{18}$ alkyl alkoxy carboxylates (especially the EO 1–5 ethoxycarboxylates), the $C_{10-18}$ glycerol ethers, the $C_{10}$–$C_{18}$ alkyl polyglycosides and their corresponding sulfated polyglycosides, and $C_{12}$–$C_{18}$ alpha-sulfonated fatty acid esters. If desired, the conventional nonionic and amphoteric surfactants such as the $C_{12}$–$C_{18}$ alkyl ethoxylates ("AE") including the so-called narrow peaked alkyl ethoxylates and $C_6$–$C_{12}$ alkyl phenol alkoxylates (especially ethoxylates and mixed ethoxy/propoxy), $C_{12}$–$C_{18}$ betaines and sulfobetaines ("sultaines"), $C_{10}$–$C_{18}$ amine oxides, and the like, can also be included in the overall compositions. The $C_{10}$–$C_{18}$ N-alkyl polyhydroxy fatty acid amides can also be used. Typical examples include the $C_{12}$–$C_{18}$ N-methylglucamides. See WO 9,206,154. Other sugar-derived surfactants include the N-alkoxy polyhydroxy fatty acid amides, such as $C_{10}$–$C_{18}$ N-(3-methoxypropyl) glucamide. The N-propyl through N-hexyl $C_{12}$–$C_{18}$ glucamides can be used for low sudsing. $C_{10}$–$C_{20}$ conventional soaps may also be used. If high sudsing is desired, the branched-chain $C_{10}$–$C_{16}$ soaps may be used. Mixtures of anionic and nonionic surfactants are especially useful. Other conventional useful surfactants are listed in standard texts.

It should be understood, however, that certain surfactants are less preferred than others. For example, the $C_{11}$–$C_{18}$ alkyl benzene sulfonates ("LAS") and the sugar based surfactants are less preferred, although they may be included in the compositions herein, in that they may interfere or otherwise act as a poison with respect to the builder material.

Adjunct Builders

One or more auxiliary builders can be used in conjunction with the crystalline calcium carbonate builder material described herein to further improve the performance of the compositions described herein. For example, the auxiliary builder can be selected from the group consisting of aluminosilicates, crystalline layered silicates, MAP zeolites, citrates, amorphous silicates, polycarboxylates, sodium carbonates and mixtures thereof. Other suitable auxiliary builders are described hereinafter.

Preferred adjunct builders include aluminosilicate ion exchange materials and sodium carbonate. The aluminosilicate ion exchange materials used herein as a detergent builder preferably have both a high calcium ion exchange capacity and a high exchange rate. Without intending to be limited by theory, it is believed that such high calcium ion exchange rate and capacity are a function of several interrelated factors which derive from the method by which the aluminosilicate ion exchange material is produced. In that regard, the aluminosilicate ion exchange materials used herein are preferably produced in accordance with Corkill et al, U.S. Pat. No. 4,605,509 (Procter & Gamble), the disclosure of which is incorporated herein by reference.

Preferably, the aluminosilicate ion exchange material is in "sodium" form since the potassium and hydrogen forms of the instant aluminosilicate do not exhibit as high of an exchange rate and capacity as provided by the sodium form. Additionally, the aluminosilicate ion exchange material preferably is in over dried form so as to facilitate production of crisp detergent agglomerates as described herein. The aluminosilicate ion exchange materials used herein preferably have particle size diameters which optimize their effectiveness as detergent builders. The term "particle size diameter" as used herein represents the average particle size diameter of a given aluminosilicate ion exchange material as determined by conventional analytical techniques, such as microscopic determination and scanning electron microscope (SEM). The preferred particle size diameter of the aluminosilicate is from about 0.1 micron to about 10 microns, more preferably from about 0.5 microns to about 9 microns. Most preferably, the particle size diameter is from about 1 microns to about 8 microns.

Preferably, the aluminosilicate ion exchange material has the formula $$Na_z[(AlO_2)_z.(SiO_2)_y]xH_2O$$

wherein z and y are integers of at least 6, the molar ratio of z to y is from about 1 to about 5 and x is from about 10 to about 264. More preferably, the aluminosilicate has the formula $$Na_{12}[(AlO_2)_{12}.(SiO_2)_{12}]xH_2O$$

wherein x is from about 20 to about 30, preferably about 27. These preferred aluminosilicates are available commercially, for example under designations Zeolite A, Zeolite B and Zeolite X. Alternatively, naturally-occurring or synthetically derived aluminosilicate ion exchange materials suitable for use herein can be made as described in Krummel et al, U.S. Pat. No. 3,985,669, the disclosure of which is incorporated herein by reference.

The aluminosilicates used herein are further characterized by their ion exchange capacity which is at least about 200 mg equivalent of $CaCO_3$ hardness/gram, calculated on an anhydrous basis, and which is preferably in a range from about 300 to 352 mg equivalent of $CaCO_3$ hardness/gram. Additionally, the instant aluminosilicate ion exchange materials are still further characterized by their calcium ion exchange rate which is at least about 2 grains $Ca^{++}$/gallon/minute/-gram/gallon, and more preferably in a range from about 2 grains $Ca^{++}$/gallon/minute/-gram/gallon to about 6 grains $Ca^{++}$/gallon/minute/-gram/gallon.

Adjunct Detergent Ingredients

The detergent compositions can include additional detergent ingredients and/or, any number of additional ingredients can be incorporated in the detergent composition during subsequent steps of the present process. These adjunct ingredients include other detergency builders, bleaches, bleach activators, suds boosters or suds suppressers, anti-tarnish and anticorrosion agents, soil suspending agents, soil release agents, germicides, pH adjusting agents, non-builder alkalinity sources, chelating agents, smectite clays, enzymes, enzyme-stabilizing agents and perfumes. See U.S. Pat. No. 3,936,537, issued Feb. 3, 1976 to Baskerville, Jr. et al., incorporated herein by reference.

Although much less preferred, minor amounts of other builders can be generally selected from the various water-soluble, alkali metal, ammonium or substituted ammonium phosphates, polyphosphates, phosphonates, polyphosphonates, carbonates, borates, polyhydroxy sulfonates, polyacetates, carboxylates, and polycarboxylates. Preferred are the alkali metal, especially sodium, salts of the above. If used, those preferred for low level use herein are the phosphates, carbonates, $C_{10-18}$ fatty acids, polycarboxylates, and mixtures thereof. Still others include sodium tripolyphosphate, tetrasodium pyrophosphate, citrate, tartrate mono- and di-succinates, and mixtures thereof (see below).

In comparison with the much less preferred soluble sodium silicates, crystalline layered sodium silicates exhibit a clearly increased calcium and magnesium ion exchange capacity. In addition, the layered sodium silicates prefer magnesium ions over calcium ions, a feature necessary to insure that substantially all of the "hardness" is removed from the wash water. These crystalline layered sodium silicates, however, are generally more expensive than soluble silicates as well as other builders. Accordingly, in order to provide an economically feasible laundry detergent, the proportion of crystalline layered sodium silicates used must be determined judiciously.

The crystalline layered sodium silicates suitable for use herein preferably have the formula $$NaMSi_xO_{2x+1}.yH_2O$$

wherein M is sodium or hydrogen, x is from about 1.9 to about 4 and y is from about 0 to about 20. More preferably, the crystalline layered sodium silicate has the formula $$NaMSi_2O_5.yH_2O$$

wherein M is sodium or hydrogen, and y is from about 0 to about 20. These and other crystalline layered sodium silicates are discussed in Corkill et al, U.S. Pat. No. 4,605,509, previously incorporated herein by reference.

Although preferably omitted from the compositions, low levels of inorganic phosphate builders may be used which include sodium and potassium tripolyphosphate, pyrophosphate, polymeric metaphosphate having a degree of polymerization of from about 6 to 21, and orthophosphates. Examples of polyphosphonate builders are the sodium and potassium salts of ethylene diphosphonic acid, the sodium and potassium salts of ethane 1-hydroxy-1, 1-diphosphonic acid and the sodium and potassium salts of ethane, 1,1,2-triphosphonic acid. Other phosphorus builder compounds are disclosed in U.S. Pat. Nos. 3,159,581; 3,213,030; 3,422,021; 3,422,137; 3,400,176 and 3,400,148, all of which are incorporated herein by reference.

Other less preferred examples of nonphosphorus, inorganic builders are tetraborate decahydrate and silicates having a weight ratio of $SiO_2$ to alkali metal oxide of from about 0.5 to about 4.0, preferably from about 1.0 to about 2.4. Water-soluble, nonphosphorus organic builders useful herein include the various alkali metal, ammonium and substituted ammonium polyacetates, carboxylates, polycarboxylates and polyhydroxy sulfonates. Examples of polyacetate and polycarboxylate builders are the sodium, potassium, lithium, ammonium and substituted ammonium salts of ethylene diamine tetraacetic acid, nitrilotriacetic acid, oxydisuccinic acid, mellitic acid, benzene polycarboxylic acids, and citric acid.

Although preferably used only at low levels (and more preferably omitted from the compositions), polymeric polycarboxylate builders are set forth in U.S. Pat. No. 3,308,067, Diehl, issued Mar. 7, 1967, the disclosure of which is incorporated herein by reference. Such materials include the water-soluble salts of homo- and copolymers of aliphatic carboxylic acids such as maleic acid, itaconic acid, mesaconic acid, fumaric acid, aconitic acid, citraconic acid and methylene malonic acid. Some of these materials are useful as the water-soluble anionic polymer as hereinafter described, but only if in intimate admixture with the non-soap anionic surfactant.

Other polycarboxylates are the polyacetal carboxylates described in U.S. Pat. No. 4,144,226, issued Mar. 13, 1979 to Crutchfield et al, and U.S. Pat. No. 4,246,495, issued Mar. 27, 1979 to Crutchfield et al, both of which are incorporated herein by reference. These polyacetal carboxylates can be prepared by bringing together under polymerization conditions an ester of glyoxylic acid and a polymerization initiator. The resulting polyacetal carboxylate ester is then attached to chemically stable end groups to stabilize the polyacetal carboxylate against rapid depolymerization in alkaline solution, converted to the corresponding salt, and added to a detergent composition. Still other polycarboxylate builders are the ether carboxylate builder compositions comprising a combination of tartrate monosuccinate and tartrate disuccinate described in U.S. Pat. No. 4,663,071, Bush et al., issued May 5, 1987, the disclosure of which is incorporated herein by reference.

Bleaching agents and activators are described in U.S. Pat. No. 4,412,934, Chung et al., issued Nov. 1, 1983, and in U.S. Pat. No. 4,483,781, Hartman, issued Nov. 20, 1984, both of which are incorporated herein by reference. Chelating agents are also described in U.S. Pat. No. 4,663,071, Bush et al., from Column 17, line 54 through Column 18, line 68, incorporated herein by reference. Suds modifiers are also optional ingredients and are described in U.S. Pat. Nos 3,933,672, issued Jan. 20, 1976 to Bartoletta et al., and 4,136,045, issued Jan. 23, 1979 to Gault et al., both incorporated herein by reference.

Suitable smectite clays for use herein are described in U.S. Pat. No. 4,762,645, Tucker et al, issued Aug. 9, 1988, Column 6, line 3 through Column 7, line 24, incorporated herein by reference. Suitable additional detergency builders for use herein are enumerated in the Baskerville patent, Column 13, line 54 through Column 16, line 16, and in U.S. Pat. No. 4,663,071, Bush et al, issued May 5, 1987, both incorporated herein by reference.

In order to make the present invention more readily understood, reference is made to the following examples, which are intended to be illustrative only and not intended to be limiting in scope.

EXAMPLE 1

Calcium Sequestration and Rate of Sequestration Test

The following illustrates a step-by-step procedure for determining the amount of calcium sequestration and the rate thereof for the crystalline calcium carbonate builder used in the compositions described herein.

1. Add to 750 ml of 35° C. distilled water, sufficient water hardness concentrate to produce 171 ppm of CaCO3;

2. Stir and maintain water temperature at 35° C. during the experiment;

3. Add 1.0 ml of 8.76% KOH to the water;

4. Add 0.1085 gm of KCl;

5. Add 0.188 gm of Glycine;

6. Stir in 0.15 gm of $Na_2CO_3$;

7. Adjust pH to 10.0 using 2N HCl and maintain throughout the test;

8. Stir in 0.15 gm of a builder according the invention and start timer;

9. Collect an alliquot of solution at 30 seconds, quickly filter it through a 0.22 micron filter, quickly acidify it to pH 2.0–3.5 and seal the container;

10. Repeat step 9 at 1 minute, 2 minutes, 4 minutes, 8 minutes, and 16 minutes;

11. Analyze all six alliquots for $CaCO_3$ content via ion selective electrode, titration, quantitative ICP or other appropriate technique;

12. The Sequestration rate in ppm $CaCO_3$ sequestered per 200 ppm of builder is 171 minus the $CaCO_3$ concentration at one minute;

13. Amount of sequestration (in ppm $CaCO_3$ per gram/liter of builder) is 171 minus the $CaCO_3$ concentration at 16 minutes times five.

For the builder material particle sizes according to the instant invention which are on the low end of the median particle size range, a reference sample is needed which is run without hardness in order to determine how much of the builder passes through the filter. The above calculations should then be corrected to eliminate the contribution of the builder to the apparent calcium concentration.

EXAMPLES II–IV

Several detergent compositions made in accordance with the invention and specifically for top-loading washing machines are exemplified below. The base granule is prepared by a conventional spray drying process in which the starting ingredients are formed into a slurry and passed though a spray drying tower having a countercurrent stream of hot air (200–300° C.) resulting in the formation of porous granules. The admixed agglomerates are formed from two feed streams of various starting detergent ingredients which are continuously fed, at a rate of 1400 kg/hr, into a Lödige CB-30 mixer/densifier, one of which comprises a surfactant paste containing surfactant and water and the other stream containing starting dry detergent material containing aluminosilicate and sodium carbonate. The rotational speed of the shaft in the Lödige CB-30 mixer/densifier is about 1400 rpm and the mean residence time is about 1–10 seconds. The contents from the Lödige CB-30 mixer/densifier are continuously fed into a Lödige KM-600 mixer/densifier for further agglomeration during which the mean residence time is about 6 minutes. The resulting detergent agglomerates are then fed to a fluid bed dryer and to a fluid bed cooler before being admixed with the spray dried granules. The remaining adjunct detergent ingredients are sprayed on or dry added to the blend of agglomerates and granules.

| | II | III | IV |
|---|---|---|---|
| Base Granule | | | |
| Aluminosilicate | 15.0 | 2.0 | 11.0 |
| Sodium sulfate | 10.0 | 10.0 | 19.0 |
| Sodium polyacrylate polymer | 3.0 | 3.0 | 2.0 |
| Polyethylene Glycol (MW = 4000) | 2.0 | 2.0 | 1.0 |
| $C_{12-13}$ linear alkylbenzene sulfonate, Na | 6.0 | 6.0 | 7.0 |
| $C_{14-16}$ secondary alkyl sulfate, Na | 3.0 | 3.0 | 3.0 |
| $C_{14-15}$ alkyl ethoxylated sulfate, Na | 3.0 | 3.0 | 9.0 |
| Sodium silicate | — | 0.1 | 0.2 |
| Brightener 24[6] | 0.3 | 0.3 | 0.3 |
| Sodium carbonate | 7.0 | 7.0 | 25.7 |
| DTPA[1] | 0.5 | 0.5 | — |
| Admixed Agglomerates | | | |
| $C_{14-15}$ alkyl sulfate, Na | 5.0 | 5.0 | — |
| $C_{12-13}$ linear alkylbenzene sulfonate, Na | 2.0 | 2.0 | — |
| $NaKCa(CO_3)_2$ | — | 7.0 | — |
| Sodium Carbonate | 4.0 | 4.0 | — |
| PolyethyleneGlycol (MW = 4000) | 1.0 | 1.0 | — |
| Admix | | | |
| Calcite (xylene sulfonate coated)* | 3.0 | 16.0 | 11.0 |
| $C_{12-15}$ alkyl ethoxylate (EO = 7) | 2.0 | 2.0 | 0.5 |
| Perfume | 0.3 | 0.3 | 1.0 |
| Polyvinylpyrrilidone | 0.5 | 0.5 | — |
| Polyvinylpyridine N-oxide | 0.5 | 0.5 | — |
| Polyvinylpyrrolidone-polyvinylimidazole | 0.5 | 0.5 | — |
| Distearylainine & Cumene sulfonic acid | 2.0 | 2.0 | — |
| Soil Release Polymer[2] | 0.5 | 0.5 | — |
| Lipolase Lipase (100.000 LU/I)[4] | 0.5 | 0.5 | — |
| Termamyl amylase (60 KNU/g)[4] | 0.3 | 0.3 | — |
| CAREZYME ® cellulase (1000 CEVU/g)[4] | 0.3 | 0.3 | — |
| Protease (40 mg/g)[5] | 0.5 | 0.5 | 0.5 |
| NOBS[3] | 5.0 | 5.0 | — |
| Sodium Percarbonate | 12.0 | 12.0 | — |
| Polydimethylsiloxane | 0.3 | 0.3 | — |
| Miscellaneous (water, etc.) | balance | balance | balance |
| Total | 100.0 | 100.0 | 100.0 |

[1]Diethylene Triamine Pentaacetic Acid
[2]Made according to U.S. Pat. No. 5,415,807, issued May 16, 1995 to Gosselink et al
[3]Nonanoyloxybenzenesulfonate
[4]Purchased from Novo Nordisk A/S
[5]Purchased from Genencor
[6]Purcbased from Ciba-Geigy
*Made by mixing sodium xylene sulfonate paste or powder with calcite from Quincy Carbonates

Having thus described the invention in detail, it will be clear to those skilled in the art that various changes may be made without departing from the scope of the invention and the invention is not to be considered limited to what is described in the specification.

What is claimed is:

1. A detergent composition for use in fabric and textile laundering comprising:

(a) from about 0.1% to about 80% by weight of a crystalline calcium carbonate substantially having a rhombohedral crystalline structure with {1,0,–1,1} crystallographic indices and having an average particle size of from about 0.4 μm to about 10 μm, said crystalline calcium carbonate having been substantially enrobed with a hydrotrope by mixing the crystalline calcium carbonate with said hydrotrope while said hydrotrope is in a liquid state;

(b) at least about 1% by weight of a detersive surfactant; and (c) the balance adjunct detergent ingredients.

2. The detergent composition of claim 1 wherein said hydrotrope is selected from the group consisting of sulfyl succinates, xylene sulfonates, cumene sulfonates, toluene sulfonates and mixtures thereof.

3. The detergent composition of claim 1 wherein said hydrotrope is sodium xylene sulfonate.

4. The detergent composition of claim 1 wherein said detergent composition is substantially free of phosphates.

5. The detergent composition of claim 1 wherein said detergent composition is substantially free of soluble silicates.

6. The detergent composition of claim 1 further comprising sodium sulfate and sodium carbonate in a weight ratio of about 1:20 to about 2:1.

7. The detergent composition of claim 1 wherein said detergent composition is substantially free of polycarboxylates.

8. The detergent composition of claim 1 further comprising a premix containing polycarboxylate and said detersive surfactant.

9. The detergent composition of claim 1 wherein said crystalline calcium carbonate is calcite.

10. The detergent composition of claim 1 further comprising sodium carbonate in a weight ratio of said crystalline calcium carbonate of from about 1:1 to about 5:1.

11. The detergent composition of claim 1 further comprising from about 0.01% to about 5% of potassium salts.

12. The detergent composition of claim 1 wherein said crystalline calcium carbonate has a surface area of from about 0.1 $m^2/g$ to about 4 $m^2/g$.

13. The detergent composition of claim 1 wherein said crystalline calcium carbonate is present in an amount from about 0.1% to about 10% by weight.

14. A detergent composition for use in fabric and textile laundering comprising:

(a) from about 0.1% to about 80% by weight of crystalline calcium carbonate, said crystalline calcium carbonate has been substantially enrobed with a hydrotrope by mixing the crystalline calcium carbonate with said hydrotrope while said hydrotrope is in a liquid state and the crystalline calcium carbonate has a rhombohedral crystalline structure with {1,0,–1,1} crystallographic indices, wherein said crystalline calcium carbonate has a an average particle size of from about 0.4 $\mu$m to about 10 $\mu$m;

(b) at least about 1% by weight of a detersive surfactant; and (c) from about 2% to about 80% by weight of sodium carbonate, wherein said sodium carbonate and said crystalline calcium carbonate are in a weight ratio of about 1:1 to about 5:1;

wherein said detergent composition is substantially free of phosphates.

15. The detergent composition of claim 14 wherein said hydrotrope is selected from the group consisting of sulfyl succinates, xylene sulfonates, cumene sulfonates, toluene sulfonates and mixtures thereof.

16. The detergent composition of claim 14 wherein said hydrotrope is sodium xylene sulfonate.

17. A method for laundering soiled fabrics comprising the steps of contacting said soiled fabrics with an aqueous solution containing an effective amount of a detergent composition according to claim 1.

18. A method for cleaning surfaces comprising the steps of contacting said surfaces with an aqueous solution containing an effective amount of a detergent composition according to claim 1.

* * * * *